US010975653B2

(12) United States Patent
Sneed et al.

(10) Patent No.: US 10,975,653 B2
(45) Date of Patent: Apr. 13, 2021

(54) DISCONNECTABLE PRESSURE-PRESERVING ELECTRICAL CONNECTOR AND METHOD OF INSTALLATION

(71) Applicant: QUICK CONNECTORS, INC., Houston, TX (US)

(72) Inventors: Brian Sneed, Houston, TX (US); Gary Firth, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 16/364,770

(22) Filed: Mar. 26, 2019

(65) Prior Publication Data

US 2019/0218878 A1 Jul. 18, 2019

Related U.S. Application Data

(63) Continuation-in-part of application No. 14/891,253, filed as application No. PCT/US2014/000092 on May 14, 2014, now Pat. No. 10,280,701.

(60) Provisional application No. 61/863,086, filed on Aug. 7, 2013, provisional application No. 61/823,054, filed on May 14, 2013.

(51) Int. Cl.

| | |
|---|---|
| ***E21B 17/02*** | (2006.01) |
| ***E21B 33/038*** | (2006.01) |
| ***E21B 33/04*** | (2006.01) |
| ***E21B 33/035*** | (2006.01) |

(52) U.S. Cl.

CPC ..... *E21B 33/0407* (2013.01); *E21B 33/0355* (2013.01)

(58) Field of Classification Search

CPC ... E21B 17/003; E21B 17/028; E21B 33/0385
See application file for complete search history.

(56) References Cited

U.S. PATENT DOCUMENTS 3,753,206 A * 8/1973 Busuttil ..... E21B 17/028 439/194
4,693,534 A * 9/1987 Clark ..... H01R 13/533 439/275
4,708,201 A * 11/1987 Reed ..... H01R 13/523 166/65.1

(Continued)

OTHER PUBLICATIONS

Lee W. Young, International Search Report dated Sep. 2, 2014, PCT Application No. PCT/US2014/000092, 2 pages.

(Continued)

*Primary Examiner* — Cathleen R Hutchins
(74) *Attorney, Agent, or Firm* — MH2 Technology Law Group LLP

(57) ABSTRACT

The present disclosure provides a dis-connectable wellhead hanger arrangement permitting a pig tail set of electrical conductors to be inserted within the wellhead hanger arrangement which seals against the wellhead hanger upon separation of an electrical power cable; or alternatively, through an exterior pressure-preserving housing. If the power cable separates from the production tubing for any reason, the compressively fit plugs disconnect the power cable from the pathway leaving the electrical mandrel sealed within the wellhead hanger or housing, thereby sealing the wellhead hanger from loss of fluid after separation.

13 Claims, 14 Drawing Sheets

(56) References Cited

U.S. PATENT DOCUMENTS

| | | | | |
|---|---|---|---|---|
| 5,377,747 | A | 1/1995 | Didier | |
| 5,626,190 | A * | 5/1997 | Moore | E21B 17/003 166/65.1 |
| 5,762,135 | A | 6/1998 | Moore | |
| 6,481,495 | B1 | 11/2002 | Evans | |
| 7,074,064 | B2 | 7/2006 | Wallace | |
| 7,369,716 | B2 | 5/2008 | Berg | |
| 2005/0042903 | A1 * | 2/2005 | Nicholson | E21B 17/023 439/201 |

OTHER PUBLICATIONS

Examiner's Report dated Jan. 29, 2020, CA Application No. 2,909,883, pp. 1-4.

* cited by examiner

DISCONNECTABLE PRESSURE-PRESERVING ELECTRICAL CONNECTOR AND METHOD OF INSTALLATION

This application claims priority to U.S. Provisional Applications No. 61/823,054, filed May 14, 2013, No. 61/863,086, filed Aug. 7, 2013, and PCT Application No. PCT/US2014/00092 filed May 14, 2014, each of which are incorporated by reference herein as if copied verbatim in their entirety; and is a continuation in part of pending application Ser. No. 14/891,253, filed Nov. 13, 2015.

FIELD OF INVENTION

The present invention relates to an electrical connector for use in a well; and, more specifically, to a dis-connectable dielectric grease-packed plug that purposefully preserves pressure within a well bore upon separation of an electrical conductor bundle from a wellhead hanger connection.

BACKGROUND OF INVENTION

Occasionally, but fortunately not often, the production tubing on an oil and gas well will fail or "part" (i.e., separate), due to corrosion problems or other severe well conditions. Most often, the tubing will separate at a threaded connection, like a coupling, or at the wellhead tubing hanger, then fall down the well bore. On a well that includes an electrical submersible pump, or down-hole heater, a power cable is fixed to this production tubing, and attached to a wellhead penetrator, or is used on a "feed-thru" type design. If the production tubing parts or separates, it will drop downward, pulling the power cable with it. This puts a severe strain on the fixed electrical penetrators at the surface wellhead, and often negates their sealing capabilities. High-pressure well fluids can then escape from the wellhead into the atmosphere. Currently, a wellhead penetrator that can maintain a reliable and expected seal upon a separation of a tubing connection, or is purpose-built to handle this catastrophic failure, does not exist. However, Applicants have developed a dis-connectable wellhead hanger connection which, if downward force is applied to the connection, allows a "clean" separation, leaving a reliable seal in the tubing hanger and preventing well fluids from escaping into the atmosphere. In an alternative embodiment disclosed herein, the pin connection is moved into a sealed housing connected to the wellhead adapter, thereby allowing through-wellhead electrical conductors to be retrofitted with pin sockets which maintain the seal on the wellhead assembly. Typically, prior connections were made with cleaned pins inserted in a dry female plug. A new pin structure and method of installation is described covering the male pin with a dielectric grease facilitating the connection process and eliminating all air pockets around the pin thereby insuring a connection unlikely to blow apart upon significant changes of pressure within the wellhead under operation.

SUMMARY OF INVENTION

This well bore connector comprises a wellhead hanger adapted to seat in a well head; an electrical connector mandrel inserted in the wellhead hanger; a female pin connection socket inserted in the electrical connector mandrel; a mini-mandrel or feed through assembly inserted in the wellhead hanger having one or more electrical conductors sealed within the mandrel and extending from the mandrel; a male pin attached to a stripped end of an electrical conductor extending from the mini-mandrel or feed through assembly inserted into the female pin socket; a dis-connectable connection between the female pin socket and male pin within the wellhead hanger, permitting separation of the mini-mandrel or feed through assembly from the electrical connector mandrel, sealing the well bore to prevent fluids from release upon disconnection.

The well bore connector provides a shoulder within the wellhead hanger to seat the electrical connector mandrel and provides O-rings to seal the electrical connector mandrel in the wellhead hanger to inhibit migration of fluids up the wellhead hanger. The electrical connector mandrel of the well bore connector is fabricated from polyether ether ketone (PEEK) and provides a shoulder to seat the female pin socket within the mandrel and a snap ring to retain the female pin socket within the mandrel. Additionally, the exterior of the female pin socket provides O-rings to seal against migration of fluids up the interior of the electrical connector mandrel and the interior of the female pin socket provides contact bands to establish a low resistance electrical connection with the male pin.

Moreover, the well bore connector described herein seals the exterior of the mini-mandrel or feed through assembly with O-rings against migration of fluids up the interior of the electrical connector mandrel and the wellhead hanger. The interior of the mini-mandrel or feed through assembly is preferably filed with epoxy around each of the one or more electrical conductors.

The well bore connector can also provide the electrical connector mandrel a stainless-steel collar between the wellhead hanger shoulder and the shoulder on the electrical connector mandrel which inhibits excessive deformation of the electrical connector mandrel in hot, high temperature wells.

Additional features that can be provided by this device include: threads for connection of a wellhead sub assembly to the electrical connector mandrel or an annular space permitting the packing of the wellhead hanger with a dielectric grease on the surface side of the wellhead hanger to inhibit the ingress of water or other contaminants into the electrical connector mandrel.

The wellhead connector can also provide the electrical connector mandrel with threads for connection of a wellhead sub-assembly to the electrical connector mandrel and a wellhead hanger which provides threads for connection of the wellhead sub assembly to the wellhead hanger.

The exterior surface of the male pin of the well bore connector provides a longitudinal slot or groove permitting excess dielectric grease covering the male pin, prior to insertion with the female pin socket, to be extruded.

Applicants also claim a well bore connector assembly connected in a wellhead hanger comprising an electrical connector mandrel inserted in the well-bore connector assembly; a female pin connection socket inserted in the electrical connector mandrel; a mini-mandrel or feed through assembly inserted in the well-bore connector assembly having one or more electrical conductors sealed within the mandrel and extending from the mandrel; a male pin attached to a stripped end of an electrical conductor extending from the mini-mandrel or feed through assembly inserted into the female pin socket; a dis-connectable connection between the female pin socket and male pin, within the well-bore connector assembly permitting separation between the electrical connector mandrel from the mini-mandrel, sealing the well bore and the well-bore connector assembly to prevent fluids from release upon disconnection.

This unitary device could be assembled off-site and installed with a compatible wellhead hanger without undue delay. Each of the features of this device replicate the features of the well bore connector previously described herein.

This application also claims a method for installing a dis-connectable electrical connection for use in a wellhead hanger which can comprise the steps of connecting a female pin connector socket to a stripped end of a upper pig tail conductor; inserting the female pin connector socket into an electrical connector mandrel until an upper end of the female pin socket seats against an internal shoulder within the electrical connector mandrel; connecting a male pin connector socket to a stripped end of a lower electrical conductor; and, inserting the male pin connector through a snap ring for insertion in the electrical conductor mandrel until the male pin engages a plurality of contact bands within the female socket end and the snap ring engages in a channel formed within an interior surface of the electrical connector mandrel.

The method of assembly can further comprise the step of covering the male pin with dielectric grease before insertion in the female pin socket to prevent ingress of fluids into the pin connection and inserting the completed assembly into a wellhead hanger. Assembly of the well bore connector assembly is readily accomplished. The assembly would be completed and taken to the wellhead having an appropriate wellhead hanger and inserted in the wellhead hanger and screwed into place by the technician retaining the complete assembly in the wellhead.

Alternatively, a wellhead extension can be connected to a wellhead adapter flange affixed to a wellhead providing an attached pressure-preserving housing, a plurality of feed-through electrical conductors attachable to sockets, contained within an insulative sleeve, joining each electrical conductor to a surface electrical source.

This alternative means for pressure-preserving attachment can be accomplished by a method for installation of the wellhead extension comprising the steps of stripping the exterior insulation from each of the electrical conductors extended from the wellhead mandrel to an exterior of a wellhead adapter flange, then inserting each stripped conductor extending from the wellhead adapter flange into a socket inserting each socket into a polyether ether ketone (PEEK) sleeve enclosed within an exterior pressure-preserving housing and capping the exterior pressure-preserving housing, joining the exterior power supply to the feed-through electrical conductors extending from the wellhead. Claims 1-17 are as provided in the prior approved application except for claim 14 which was cancelled in a prior office response. Drawings of FIGS. 1-8 are identical to those provided in the prior application. FIGS. 9 and 10, and claims 18 and 19 are added by this Continuation in Part.

DETAILED DESCRIPTION OF THE INVENTION

Figure 1A:
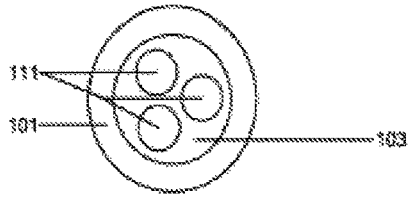
FIG. 1A is an end view of the three conductors in the seal sub showing the spatial distribution of each in the dis-connectable pressure-preserving electrical connector of the present invention.
Figure 1:
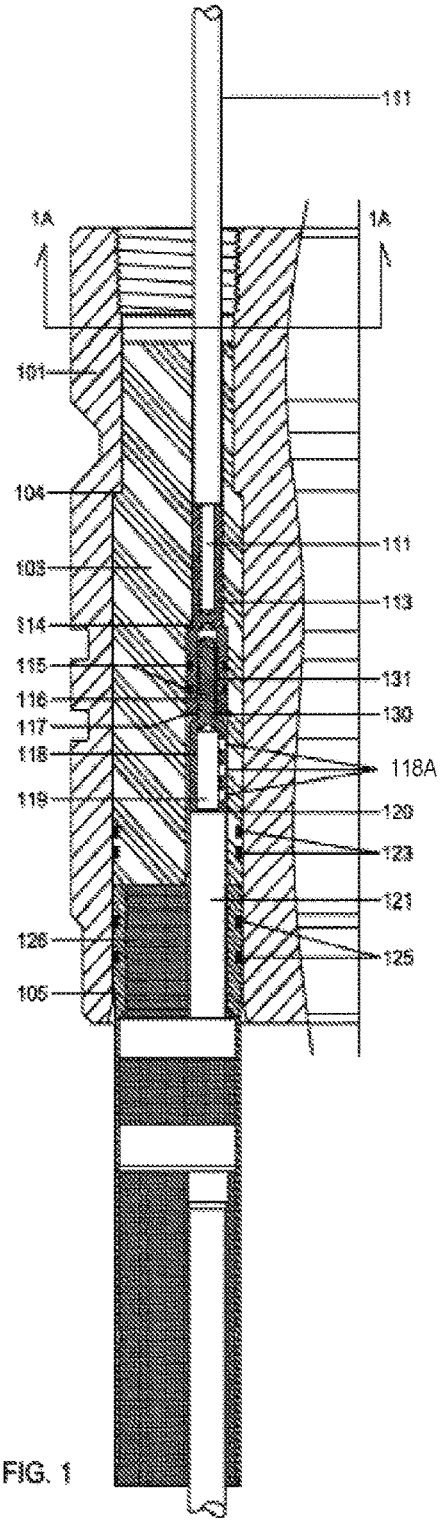
FIG. 1 is a cross-sectional side view of the dis-connectable pressure-preserving electrical connector threaded into a wellhead.

FIG. 1 shows an embodiment of this invention providing an electrical connector mandrel 103 installed into a wellhead hanger 101. The electrical connector mandrel 103 seated on interior wellhead shoulder 104 and is sealed within the wellhead hanger 101 with O-rings 123 thereby preventing fluid under pressure from leaking out of the well bore. Surface power cable leads or pigtails 111 are inserted into the interior of the wellhead hanger 101, then into the electrical connector mandrel 103. While only one electrical cable is shown in FIG. 1 on the interior of the electrical connector mandrel 103, there are three such conductors for the three-phase electrical power required by all modern ESPs. The relative position of each of these conductors is more fully shown in FIG. 1*a* that shows a cross-sectional view of the three conductors 111 in electrical connector mandrel 103 seated within the wellhead hanger body 101.

Upon installation of this assembly, a female pin connection socket 113 of FIG. 1 is inserted into the electrical connector mandrel 103 seating on shoulder 114 and provides O-rings 115 around its exterior distal end to seal against the interior of the electrical connector mandrel 103. The stripped end 119 of the electrical cables 121 from the ESP are inserted into the male pin connector sleeve 118 from below and affixed therein by set screws 118A in this embodiment and can compressively engage on contact bands 116 on the interior of the female connector sleeve or pin connection socket 113. The electrical cable is stripped to a distance at 120 to seat the pin connection sleeve 118. The pin connection sleeve 118 could alternatively be attached to the electrical cable 121 by crimping over the stripped end of the electrical cable 119. The female pin connection socket 113 is retained within the electrical connector mandrel 103 by snap ring 117, which is inserted upon installation into a circular groove 130 formed on the interior of the electrical connector mandrel 103. The mini-mandrel or feed through assembly 105 is filled with epoxy 126 thereby sealing the upper portion of the feed through assembly 105. If the electrical conductors or their shielded cable are separated from the wellhead hanger 101, this female pin connection socket 113 would allow the cabling to separate and freely disconnect and drop away from the wellhead hanger 101 without opening the wellhead hanger 101 to the internal well pressure. Since the connector is confined within the electrical connector mandrel 103, there is no chance of escape of well fluids under potential high pressure.

Figure 1B:
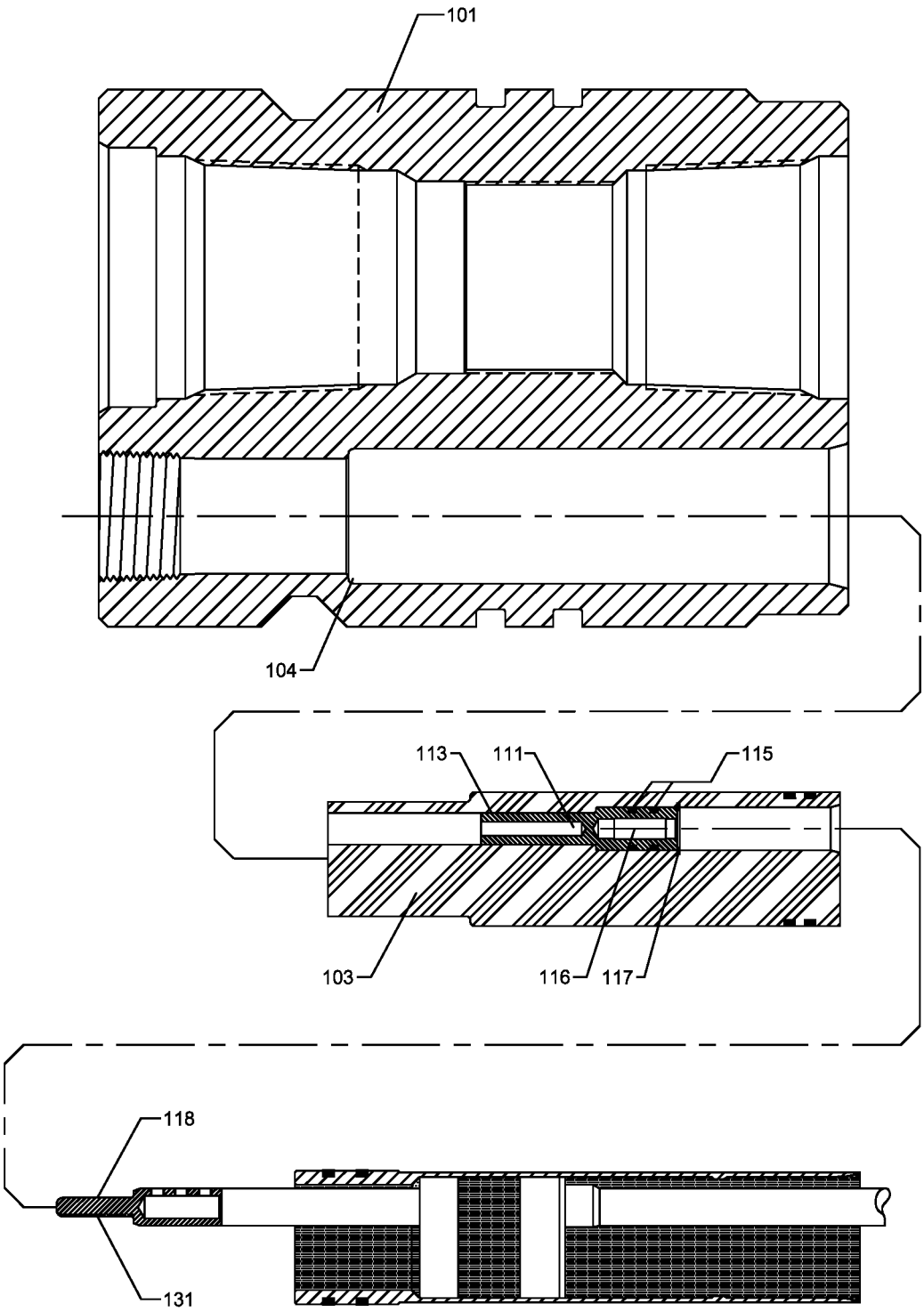
FIG. 1B is an exploded view of the various elements of the wellhead hanger and electrical connector mandrel dis-connected from the mini-mandrel or feed through assembly of the upper connection and from the electrical cable set.

FIG. 1*b* is an exploded view of the embodiment described above. The wellhead hanger body 101 provides a distinct shoulder 104 permitting the electrical connector mandrel 103 to be inserted until it seats against the shoulder 104. The female pin socket 113 is attached to the stripped end of the surface cable 111' in a manner not shown herein but could be by crimping, set screws, welding or the like because these pig tails can be assembled off site. A slot or groove 131 allows a dielectric silicone grease, such as Dow Corning® DC 111, to be installed over the male pin 118 prior to insertion in the female pin connection socket 113. Wear or contact bands 116 are more clearly depicted in this view and allow the male pin 118 to seat in the female pin connection socket 113. This connection is made with little or no electrical resistance despite having a thick layer of dielectric grease smeared over the male pin 118 prior to insertion in the female pin socket 113. All of the other features shown in FIG. 1*b* are identical to those shown and described in FIG. 1.

Figure 2:
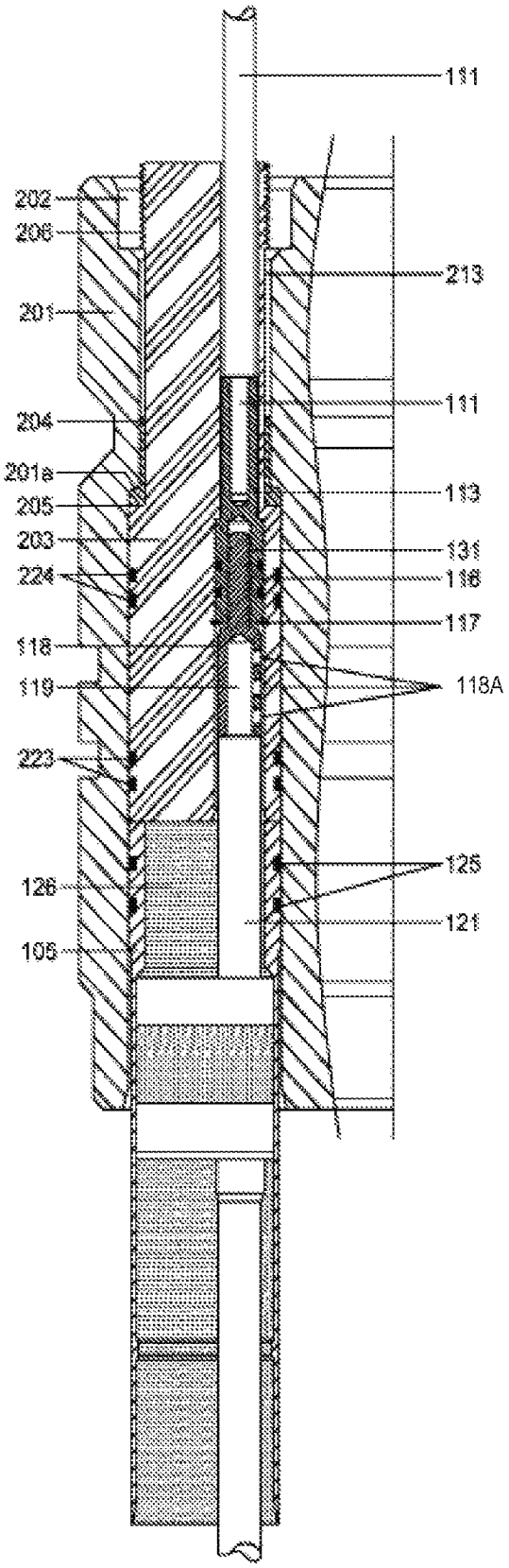
FIG. 2 is cross-sectional side view of an alternative embodiment of the disconnectable pressure-preserving electrical connector seated on a steel collar and threadable into a seal sub assembly located on the wellhead external surface.

FIG. 2 is a modified embodiment of the present invention showing an electrical connector mandrel 203 compressively seated in a wellhead hanger recess 202. Each electrical conductor can also be inserted in an elastomeric seal (not shown) on an interior surface of a seal sub (not shown), all in a manner well known in this art.

Figure 2A:
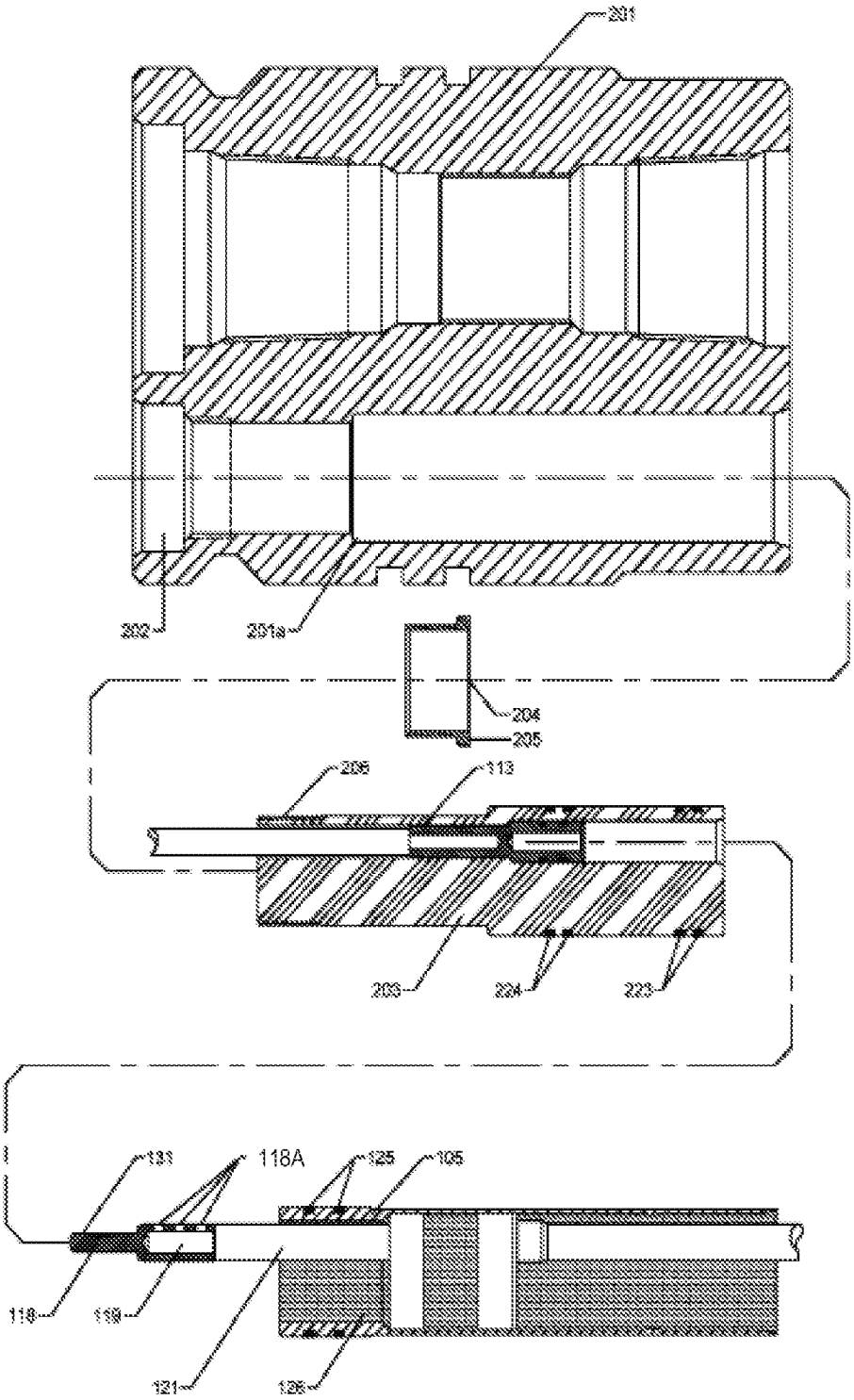
FIG. 2A is an exploded side view of the elements of the embodiment shown in FIG. 2.

All of the described embodiments, shown in FIGS. 1-5 and 7 provide similar elements and are installed in a similar manner. For example, FIG. 2*a* is an exploded view of the structure shown in FIG. 2 showing the stainless steel collar 204, creating an interior shoulder 205 provided to prevent extrusion of the PEEK internal electrical mandrel 203 in high temperature, high pressure well situations; the threading 206 on the exterior end of the electrical mandrel 203 for connection to a well head device such as a seal sub (not shown in this view), and more clearly shows the wear bands 116 on the interior of the female pin socket 113.

Figure 3:
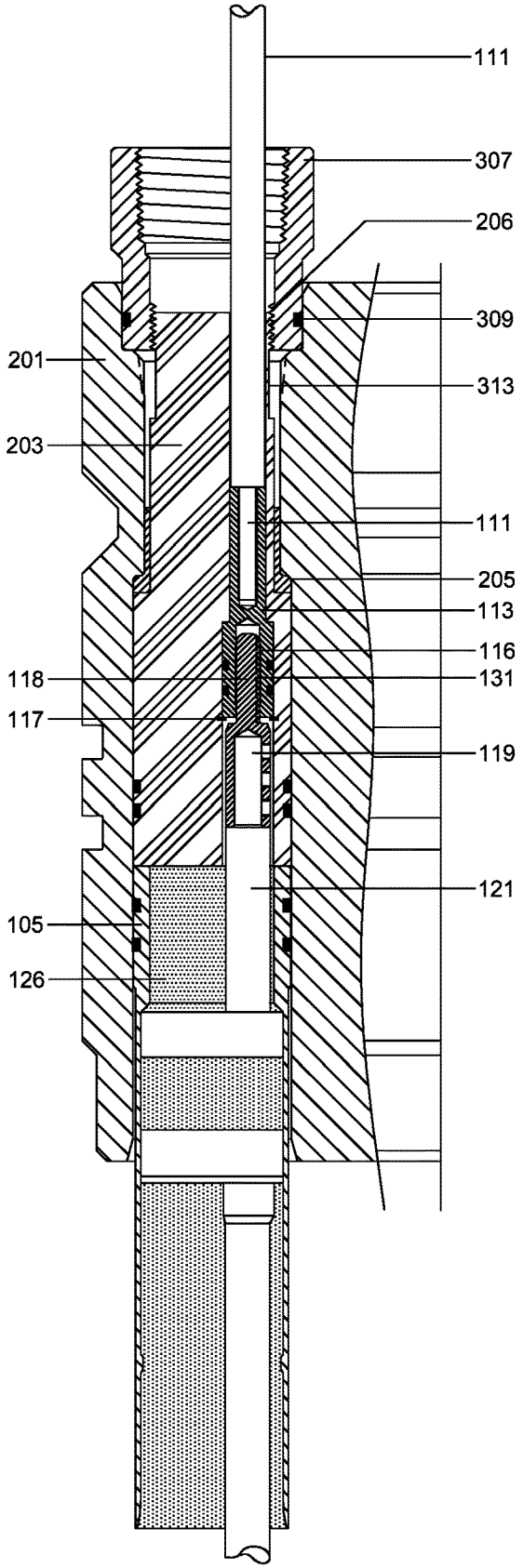
FIG. 3 is a cross-sectional side view of the invention showing the connection to the seal sub assembly inserted into a groove in the wellhead hanger and showing an annular void at the wellhead groove for insertion of packing material.
Figure 3A:
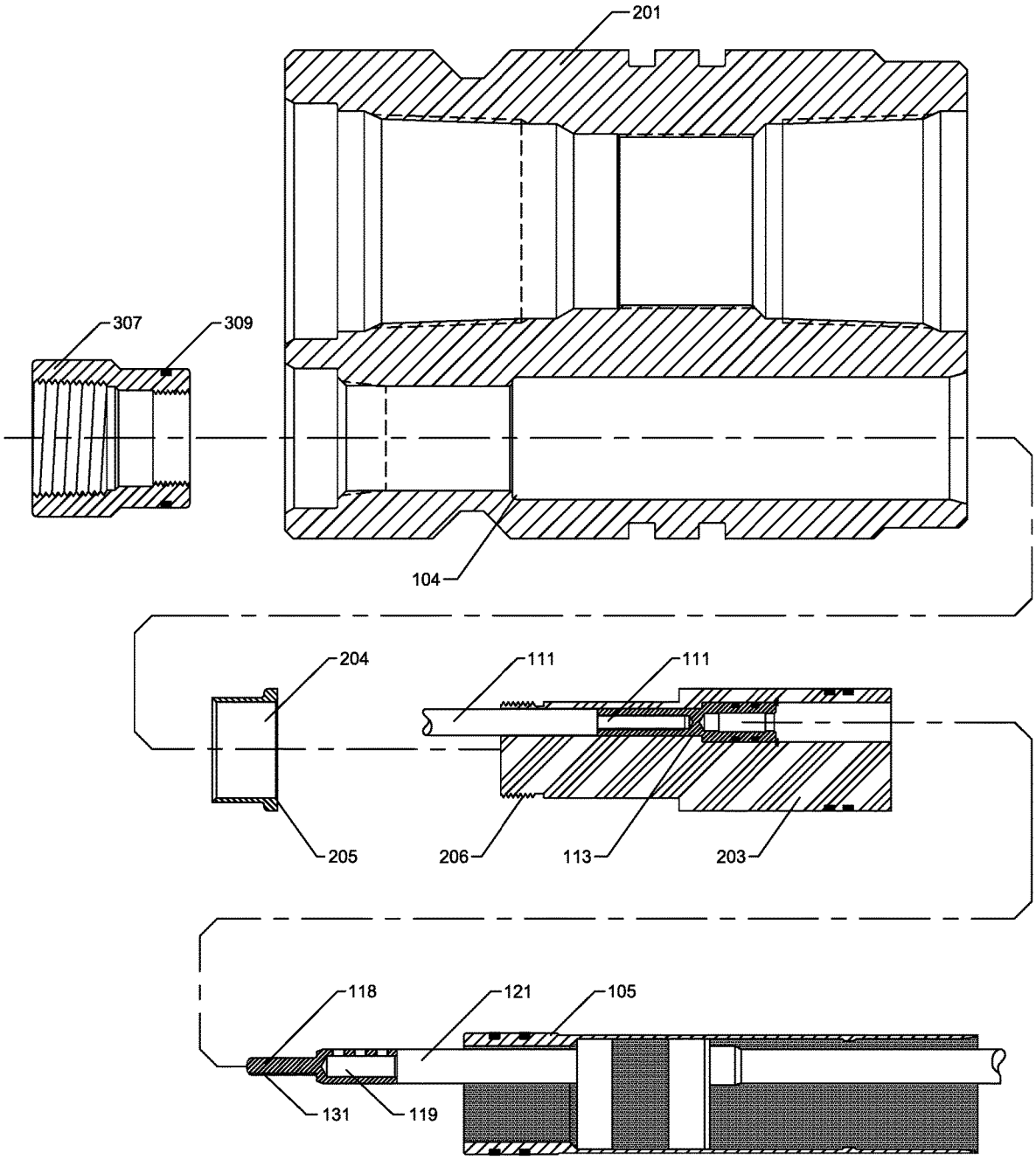
FIG. 3*a* is an exploded side cross-sectional view of each of the parts of the embodiment shown in FIG. 3.

Similarly, FIG. 3A is an exploded view of the structure shown in FIG. 3 that shows the seal sub 307 connected to the threaded end of the internal electrical mandrel 203 and seated within the groove on the wellhead hanger 201. The upper portion of each electrical conductor 121 extending from the ESP cable through the mini-mandrel or feed through assembly 105 to the surface is stripped at its proximal end 119 for insertion in a male pin 118 which is inserted into the female pin socket 113, and the entire assembly is moved into the internal electrical connector mandrel 103, 203, while the stripped end of an exterior cable having a male socket pin 118, attached on the stripped end 119 of the conductor 121, is moved into the electrical connector mandrel 103, 203, to seat within the female pin socket 113. Both the male pin 118 and the female pin connector socket 113 are attached, such as by crimping the exposed end of the conductor on the interior of each respective pin socket. The preferred method for connection of both the male and female socket is by set screws.

Figure 4:
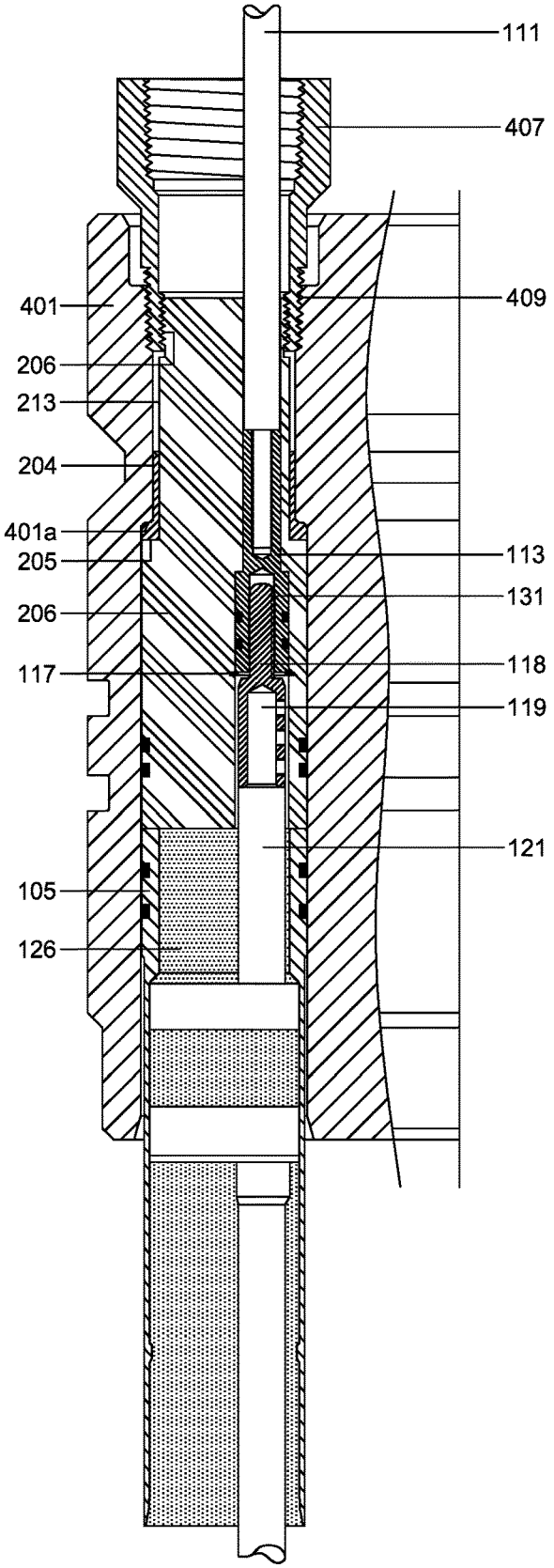
FIG. 4 is another embodiment of the dis-connectable pressure-preserving electrical connector threadably engaging a seal sub assembly inserted in the top of a wellhead hanger.
Figure 4A:
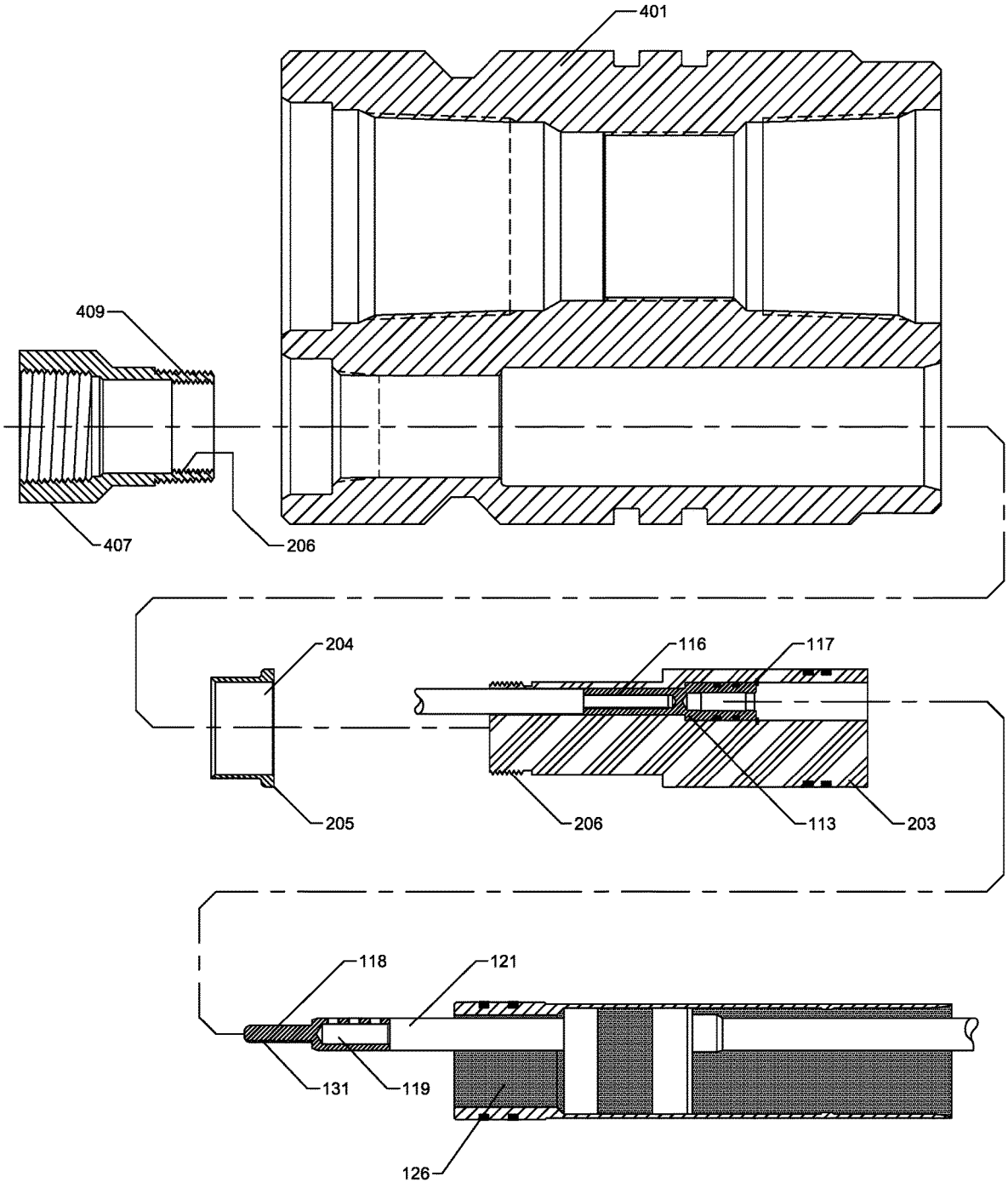
FIG. 4A is an exploded side cross-sectional view of the embodiment described in FIG. 4.

Finally, FIG. 4*a* shows an exploded view of the structure of FIG. 4 showing the seal sub 407 threaded both internally and externally for seating the sub in the wellhead hanger with threads 409 and the internal threads connecting to the threaded end of the internal electrical mandrel 206.

Dielectric grease, such as Dow Corning Corporation's DC 111, coats the exterior of the insulation of the electric conductor cable 118, to prevent ingress of fluids which might short the electrical connection between the male and female sockets. The same dielectric grease can be used to coat the upper electrical conductor set 111, 111' as they enter the exterior of the wellhead hanger through the seal subs 307, 407 in FIGS. 3-4, thereby preventing water or contaminants from reaching the socket connection on the interior of the electrical connector mandrel.

Upon separation of the production tubing from below the wellhead hanger, the mini-mandrel or feed through assembly 105, in each figure would drop away from the electrical connector mandrel 103, 203 as shown more specifically in FIGS. 1-5 and 7 removing the electrical cable 119 in its insulation 121 and disconnecting the pin connection sleeve 118, from the female pin socket 113, that remains sealed within the wellhead hanger 101 thereby preventing the egress of high pressure fluids up the interior of the wellhead hanger 101, 201, 401, 601. More particularly, as shown, the mini-mandrel 105 is configured to slide axially out of the wellhead hanger 101, 201 in response to the production tubing parting below the wellhead hanger 101, 201, without removing of the electrical connector mandrel 103, 203 from within the wellhead hanger 101, 201 so as to prevent releasing fluids from the well bore upon parting of the production tubing.

Each of the embodiments shown herein is structurally similar. Only changes in the wellhead hanger are made to accommodate the needs of the particular application of this invention. For example, FIG. 1 describes the electrical connector mandrel 103 inserted in the wellhead hanger 101 as seated on a shoulder 104 on said wellhead hanger 101. This design is modified in FIGS. 2, 3 and 4 to provide a stainless-steel collar 204 which provides a broader shoulder 205 to inhibit extrusion of the PEEK material from which the electrical connector mandrel 203 is formed when experience excessive pressure from the well bore (not shown). FIGS. 2, 3 and 4 also disclose a space 213, 313 formed between the exterior of the electrical connector mandrel 203 and the interior surface of the wellhead hanger 201.

Figure 5:
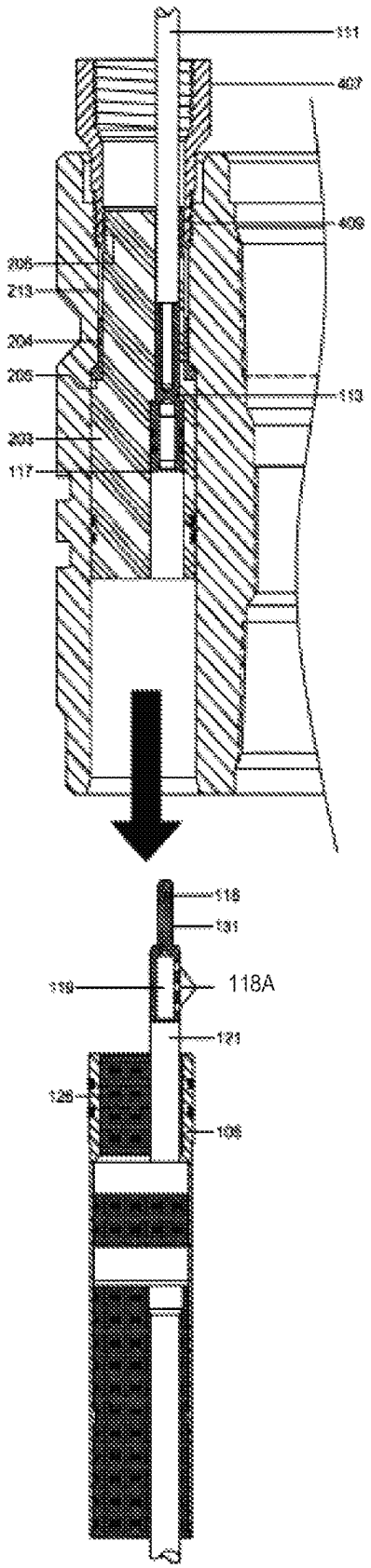
FIG. 5 describes the components of the dis-connectable pressure-preserving electrical connector showing the point of separation of the mini-mandrel or feed through assembly from the electrical connector mandrel which remains sealed within the wellhead hanger.

FIG. 5 describes the remaining seal left in the wellhead retaining the PEEK mandrel 203 after separation of the mini-mandrel or feed through assembly 105 from the wellhead.

Figure 6:
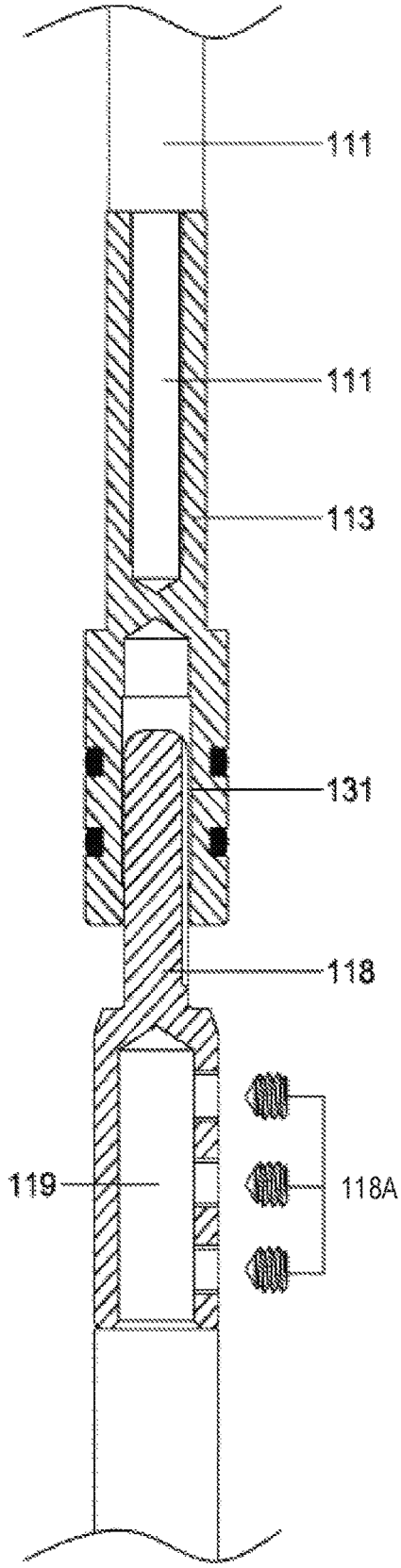
FIG. 6 is a detailed drawing of the female pin socket connected to the stripped end of the first electrical conductor entering from the surface and the male pin connector having a longitudinal slot or groove, which is attached with set screws to the stripped end of the second electrical conductor extending into the well bore.

FIG. 6 is a closer cross-sectional view of the male pin assembly 118 which provides a longitudinal groove or slot 131 permitting an excess of a dielectric grease such as DC 111 to be extruded from the female socket 113 attached to the stripped end 111' of electrical conductor 111. Male pin 118 is connected to stripped electrical conductor 119 by set screws 118A but could be attached by other means such as crimping or the like.

Figure 7:
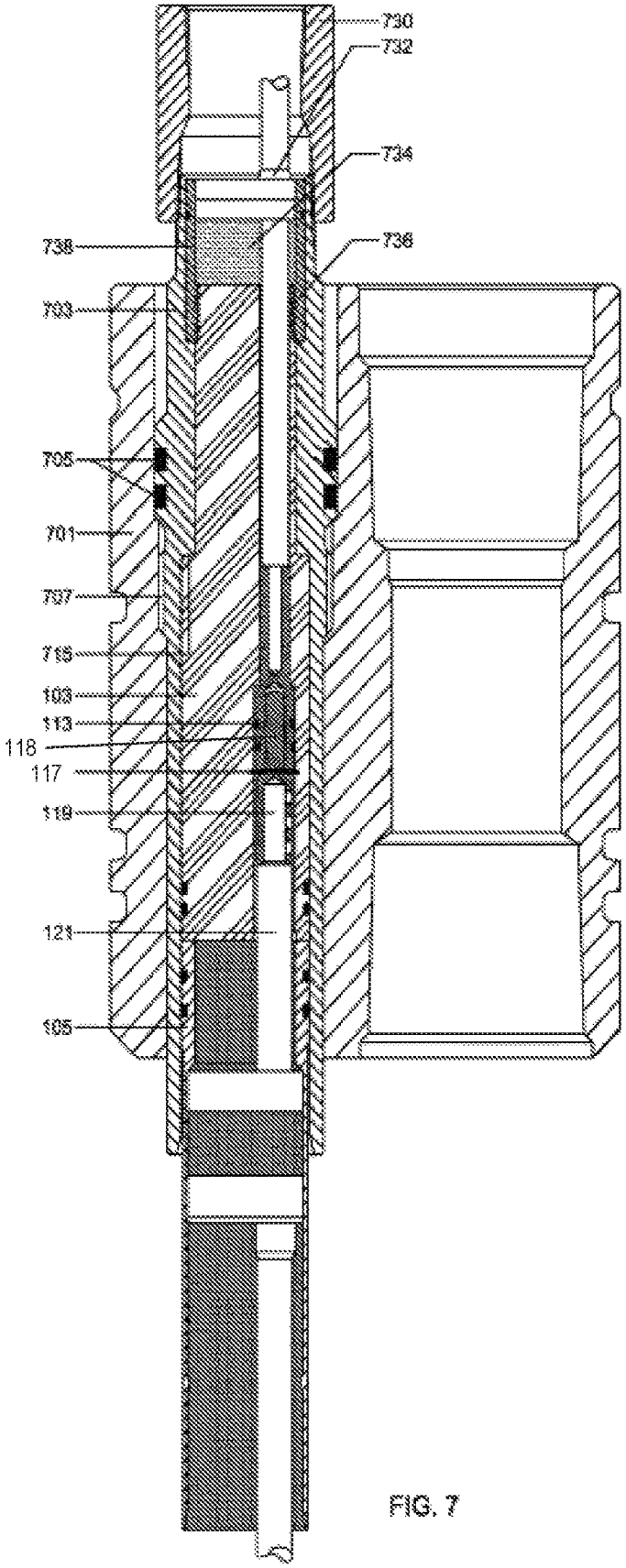
FIG. 7 is a cross-sectional side view of another embodiment showing a mandrel seated within a wellhead hanger and connected to an internal electrical connector mandrel having a canned pump coupler which permits a dis-connectable pressure-preserving seal if the production tubing and the attached electrical cable connector part from the wellhead hanger.

Similarly, another embodiment can allow connection of the disconnectable assembly to a canned pump coupling as shown in FIG. 7, which functions in the same manner as the previously discussed embodiments. The feed-through assembly 105 is inserted into a dummy wellhead mandrel 703 threaded into the wellhead from above and connecting with threads 707. The dummy mandrel seals in the wellhead with O-rings 705. The canned pump coupler 730 is connected to the conductors emerging from the PEEK mandrel assembly 103 providing a threaded upper end 736 for attachment to the retaining sleeve 738. Dielectric grease 734 is inserted between the top of the PEEK mandrel 103 and the bottom of a trash seal 732 through which each of the three conductors are guided into the canned pump coupler 730. In all other respects, this embodiment functions in the same manner as the previous embodiments. The PEEK mandrel 103 seats against the internal shoulder 715 retaining the pressure seal at the wellhead even if the conductors separate and fall back into the well.

Figure 8:
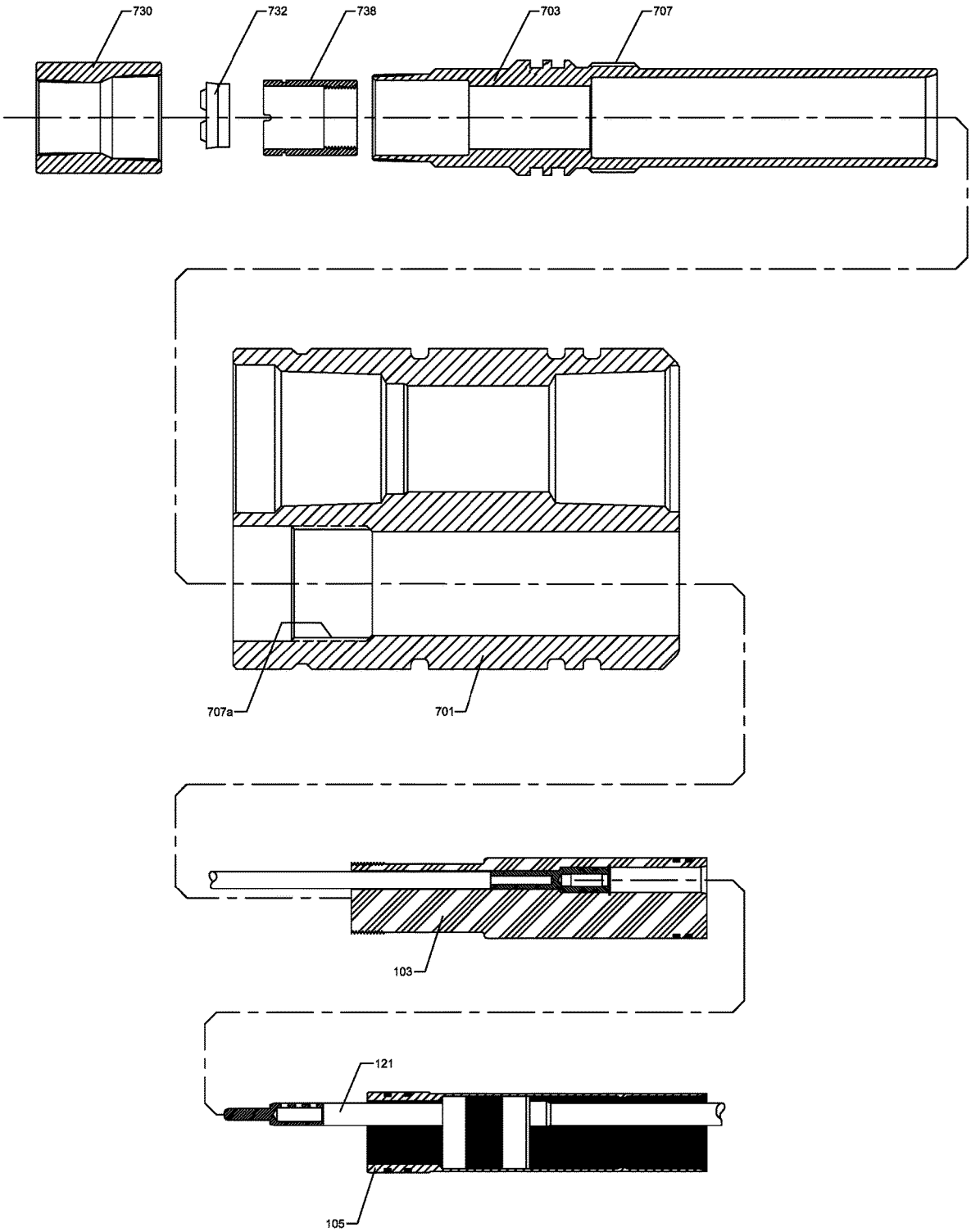
FIG. 8 is an exploded view of the embodiment described in FIG. 7 above.

FIG. 8 is an exploded view of the embodiment described in FIG. 7. Wellhead 701 is constructed with a feed through assembly 105 which, along with the PEEK mandrel 103, is inserted into the dummy mandrel 703 and then screwed into the interior threads of the wellhead 707*a*. Retaining sleeve 738 contains the trash seal 732 and is filled with dielectric grease to prevent the entry of water or dirt into the top of the wellhead pressure preserving penetrator of the present invention. The canned pump coupler 730 is connected to the retaining sleeve 738.

Figure 9:
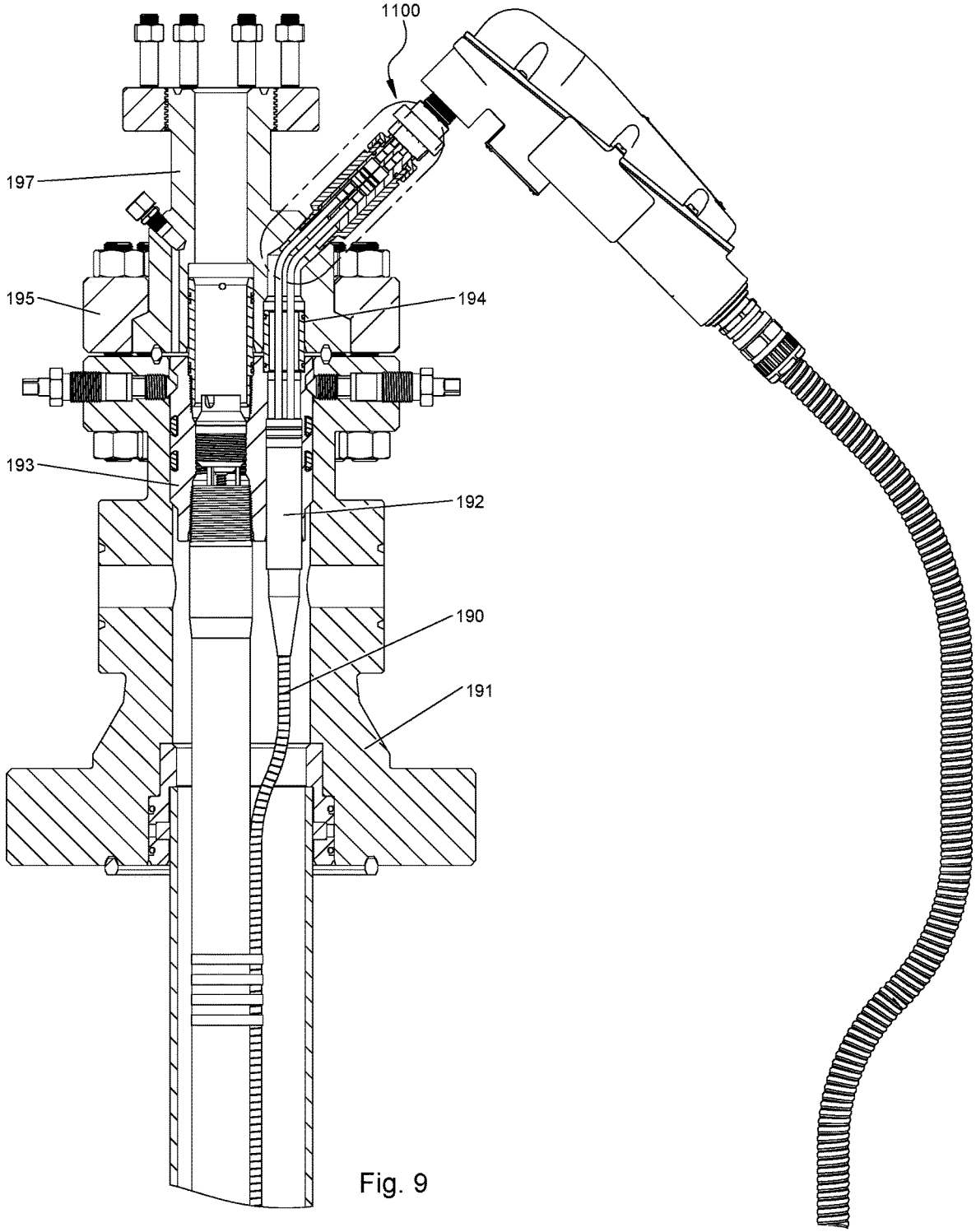
FIG. 9 is a cross-sectional view of alternative embodiment of a pressure-preserving wellhead connector.
Figure 10:
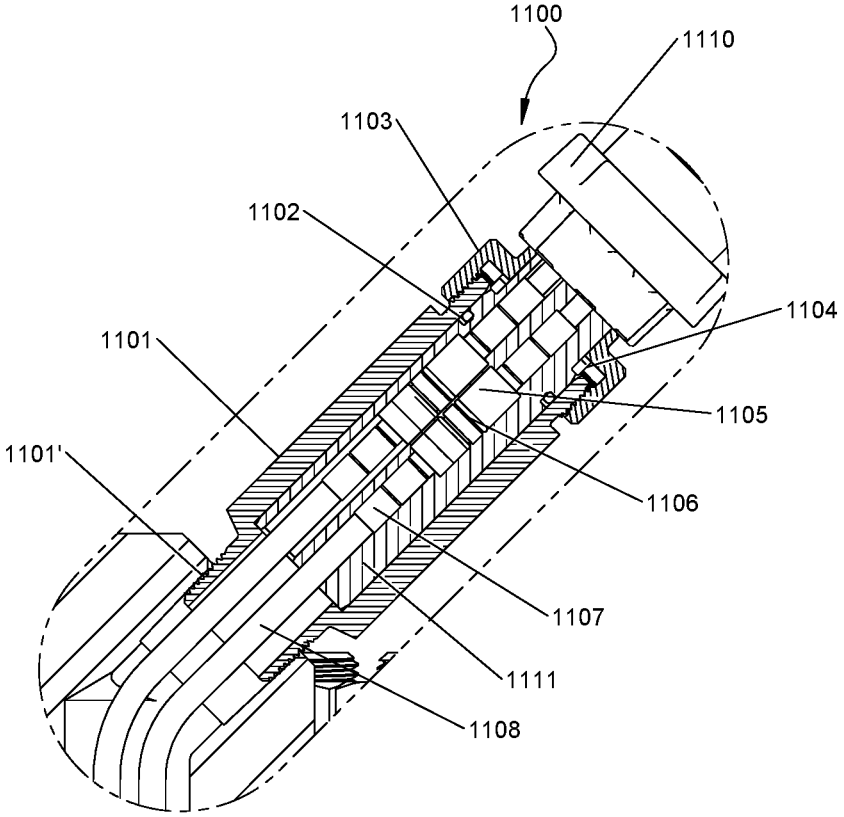
FIG. 10 is a cross-sectional view of the details of the pressure-preserving well head connector.

Alternatively, as shown in FIG. 9, and to provide a retrofit to existing wellhead electrical connections which provide continuous electrical conductors extending from a wellhead mandrel 192 through the wellhead 191 and wellhead hanger 193, an exterior pressure preserving body 1100 can be threaded on a wellhead adapter 197 affixed to a wellhead 191 with adapter flange 195. The electrical conductors 1108 (as shown in FIG. 10) are inserted through a seal-sub guide 194 on FIG. 9. The wellhead mandrel 192 can accommodate either flat or round ESP cables 190.

As shown in FIG. 10, each conductor 1108 inserted in the wellhead mandrel 192 of FIG. 9 is stripped of its exterior insulation and inserted in a female socket. The sockets can be either pinned or crimped. FIG. 10 shows female crimp socket 1105. Each of these crimp sockets provide a crimp pin 1107 and O-rings 1106 to seal on the interior of the PEEK sleeve. Prior to inserting the male stripped end in each crimp socket the interior of female socket can be stuffed with a dielectric silicone grease which eliminates voids within the socket and facilitates insertion of the pin in the socket which also provide internal cable bands to enhance conductivity.

Each conductor crimp socket is inserted within PEEK sleeve 1111 which insulates the crimp sockets from the exterior housing 1101 fabricated from either stainless steel or 4130 steel, and which is threaded using threads 1101' into flange adapter 195 of FIG. 9. The PEEK sleeve 1111 of FIG. 10 also provides an exterior O-ring 1102 providing additional sealing of the crimp sockets within the PEEK sleeve. The exterior housing 1101 is sealed by a cap 1103 which allows the union connector 1110 to complete the connection. Cap 1103 compresses a ring 1104.

Each of the alternative disclosed herein derive from a common structure and are variations of the disclosure made herein. Other alternatives can be fashioned from a similar disclosure without departing from the spirit or intent of this invention.

The accompanying drawings and description referred to herein are illustrative of the invention but not restrictive thereof and together with the description serve only to explain the principles of the invention claimed herein.

What is claimed is:

1. A wellhead connector comprising:

a wellhead hanger adapted to seat in a wellhead and connect to a production tubing;

an electrical connector mandrel inserted in the wellhead hanger;

a female pin connection socket inserted in the electrical connector mandrel;

a mini-mandrel inserted in the wellhead hanger having one or more electrical conductors sealed within the mini-mandrel and extending from the mini-mandrel; and a male pin attached to a stripped end of the one or more electrical conductors extending from the mini-mandrel inserted into the female pin socket wherein the mini-mandrel is configured to slide axially out of the wellhead hanger in response to the production tubing parting below the wellhead hanger, without removing of the electrical connector mandrel from within the wellhead hanger so as to prevent releasing fluids from the well bore upon parting of the production tubing, wherein the electrical connector mandrel is seated against a shoulder with the wellhead hanger and provides O-rings to seal against migration of fluids up the wellhead hanger, and wherein the electrical connector mandrel provides a shoulder to seat the female pin socket within the electrical connector mandrel and a snap ring to retain the female pin socket within the electrical connector mandrel.

2. The wellhead connector of claim 1, wherein the electrical connector mandrel is fabricated from polyether ether ketone ("PEEK").

3. The wellhead connector of claim 1, wherein an exterior of the female pin connection socket provides O-rings to seal against migration of fluids up an interior of the electrical connector mandrel.

4. The wellhead connector of claim 3, wherein an interior of the female pin connection socket provides contact bands to establish a low resistance electrical connection with the male pin.

5. The wellhead connector of claim 4, wherein the exterior of the mini-mandrel provides O-rings to seal against migration of fluids up the interior of the electrical connector mandrel and the wellhead hanger.

6. The wellhead connector of claim 5, wherein the interior of the mini-mandrel is filed with epoxy around each of the one or more electrical conductors.

7. The wellhead connector of claim 6, wherein the electrical connector mandrel seats on a stainless-steel collar between the wellhead hanger shoulder and the shoulder on the electrical connector mandrel.

8. The wellhead connector of claim 7, wherein the electrical connector mandrel provides threads for connection of a wellhead sub assembly to the electrical connector mandrel.

9. The wellhead connector of claim 8, wherein the electrical connector mandrel provides an annular space permitting the packing of the wellhead hanger with a dielectric grease to inhibit the ingress of water or other contaminants into a space between the exterior of the electrical connector mandrel and an interior surface of wellhead hanger from the top of the wellhead.

10. The wellhead connector of claim 9, wherein the electrical connector mandrel provides threads for connection of a wellhead sub assembly to the electrical connector mandrel and the wellhead sub assembly provides threads for connection of the wellhead sub assembly to the wellhead hanger.

11. The wellhead connector of claim 10, wherein an exterior surface of the male pin provides a longitudinal groove permitting excess dielectric grease covering the male pin to be extruded from the female pin socket.

12. The wellhead connector of claim 1, wherein the male pin is configured to slide axially out of engagement with the female pin connection socket without removal of the electrical connector mandrel from within the wellhead hanger, such that the male pin is configured to move out of the wellhead hanger along with the mini-mandrel without damaging the female pin connection socket.

13. The wellhead connector of claim 1, wherein the electrical connector mandrel forms a seal with the wellhead hanger, such that the electrical connector mandrel is configured to seal the well bore independently of the mini-mandrel, and wherein the mini-mandrel sliding out of the wellhead connector does not impair the seal.

* * * * *